US006145828A

United States Patent [19]

Arai

[11] Patent Number: 6,145,828

[45] Date of Patent: Nov. 14, 2000

[54] SHEET CONVEYOR SINGLE-HANDED PARTING ENGAGEMENT MECHANISM

[75] Inventor: Kiyotaka Arai, Osaka, Japan

[73] Assignee: Mita Industrial Co., Ltd., Osaka, Japan

[21] Appl. No.: 09/201,617

[22] Filed: Nov. 30, 1998

[30] Foreign Application Priority Data

Nov. 28, 1997 [JP] Japan ..... 9-329255

[51] Int. Cl.[7] ..... B65H 5/21; B65H 29/00; B65H 5/02; G03G 15/20

[52] U.S. Cl. ..... 271/3.03; 271/186; 271/273; 399/124

[58] Field of Search ..... 271/3.03, 291, 271/301, 186, 272, 273, 65; 399/124, 402, 401

[56] References Cited

U.S. PATENT DOCUMENTS

| | | | |
|---|---|---|---|
| 3,661,383 | 5/1972 | Morrison | 271/273 |
| 4,538,906 | 9/1985 | Brown | 271/301 |
| 4,949,134 | 8/1990 | Iwaki et al. | 271/240 |
| 5,293,203 | 3/1994 | Wada et al. | 271/301 |
| 5,337,134 | 8/1994 | Sato et al. | 271/291 |
| 5,727,784 | 3/1998 | Sagawa | 271/272 |
| 5,857,138 | 1/1999 | Ida et al. | 271/3.03 |

FOREIGN PATENT DOCUMENTS

| | | | |
|---|---|---|---|
| 0116431 | 5/1987 | Japan | 271/273 |
| 0138072 | 5/1990 | Japan | 271/273 |
| 0305733 | 12/1990 | Japan | 271/273 |
| 404125248 | 4/1992 | Japan | 271/272 |

*Primary Examiner*—Donald P. Walsh
*Assistant Examiner*—Daniel K Schlak
*Attorney, Agent, or Firm*—Shinjyu An Intellectual Property Firm

[57] ABSTRACT

In a sheet conveying unit, two conveying sections turn linked and spaced apart such that sheet jams arising in the course of conveyance through the conveying sections can be easily cleared single-handedly. Wherein the sheet-conveying unit functions to turn over, convey and store sheets in a dual-sided copying section inside a copying machine main body (1), it may include a main frame (30) that is withdrawable frontward from the copying machine main body (1); an intermediate tray (31) storing the reversed sheets; a lower conveyor (32); an upper conveyor (33); and a linkage (34). The upper and lower conveyors (33, 32) have upper and lower conveying guides (50, 45) and upper and lower conveying rollers (51, 46), respectively, and both conveyors are open/closable on the main frame (30) disposed above the intermediate tray (31). One end of the linkage (34) is pivotably fit in the upper conveying guide (50), and the other end is engaged in the lower conveying guide (45) so that both conveying guides (45, 50) turn linked and spaced apart at predetermined intervals and lock at the predetermined intervals.

11 Claims, 15 Drawing Sheets

SHEET CONVEYOR SINGLE-HANDED PARTING ENGAGEMENT MECHANISM

BACKGROUND OF THE INVENTION

1. Technical Field

The present invention relates to sheet conveyance in image reproducing apparatuses such am electrostatographic printers and copiers; in particular, the present invention relates to portions of the sheet conveyance system in such image-reproducing apparatuses that are operator-accessible for maintenance such as clearing sheet jams.

2. Description of Related Art

Image reproducing devices such as electrostatographic copying machines, printers and facsimile devices, are equipped with a sheet conveyance system for conveying sheets in transport from the sheet supply section of the apparatus through the image reproducing and finishing sections to a discharge or storage location.

To facilitate sheet removal in the event of sheet jams in such sheet conveyance systems, it in well known to make portions of the system withdrawable. For example, mechanism frames of the sheet conveyance system are designed to be withdrawable frontward (in terms of where an operator runs the machine).

Among such image reproducing devices are photocopiers capable of dual-sided printing, in which case the sheet conveyance system will have a section that turns over once-printed sheets and re-supplies them to the image-reproducing station which may be, for example, the photoconductive drum of electrostatographic devices. Herein it is also known to make such a dual-sided sheet handling section of the sheet conveyance system withdrawable for operator maintenance access.

Such a sheet conveyance system dual-sided sheet handling section comprises a main frame withdrawable frontward of the photocopier, an intermediate tray fitted to the main frame for storing sheets turned over therein in transport, and upper and lower conveyors disposed above the intermediate tray. Each of the conveyors has a conveying guide, one end of which is pivotably supported on the main frame, and conveying rollers rotatably fitted into the conveying guide. The conveying rollers of the upper and lower guides are disposed pressing on each other. Sheets in conveyance therein are thus pinched by opposing roller pairs and turned over and sent toward the intermediate tray.

In addition, the upper and lower conveying guides are joined by a linkage by which they are spaced apart in turning open the main frame. Therein, with the main frame withdrawn, when the free end of the upper conveying guide is grasped and rotated, the upper conveying guide is turned a predetermined amount, whereupon the lower conveying guide is subsequently brought into the turning movement.

In a sheet conveyance system of the above-described configuration, sheets may become jammed on the intermediate tray, and between the upper and lower conveyors. Hence, the conveyor pair is rotatably fit into the main frame, off and onto which the pair can be opened and closed.

That is, when a sheet jam occurs between the upper and lower conveyors, it can be cleared by drawing the main frame out of the photocopier, and grasping and lifting only the upper conveying guide in order to take out the sheet. Wherein a sheet jam occurs on the intermediate tray, however, the upper conveying guide must be lifted far enough to bring the lower conveying guide into the turning movement via the linkage, which then opens up the area over the intermediate tray so that the jammed sheet can be cleared. Accordingly, owing to the conveying guide pair linkage, wherein sheets have become jammed in either of the pair of regions they can be removed by only turning the upper conveying guide.

In the above-described conventional sheet conveyance system, owing to the linkage of the upper and lower conveying guides, sheet jams at the pair of locations can be dealt with by only lifting the upper conveying guide to turn open the dual-sided sheet handling section. Nevertheless, since the upper and lower conveying guides only swing on their link, if the hand lifting the upper conveying guide is removed, being that the upper conveying guide is urged towards the lower conveying guide side by gravity, the upper conveying guide will fall through the turn approaching the lower conveying guide. Consequently, wherein there is a sheet jam between the upper and lower conveying guides, a two-handed process becomes necessary—for example, while the upper conveying guide is held by the right hand, the jammed sheet is removed away by the left hand—such that the jammed sheet clearing process is cumbersome.

SUMMARY OF THE INVENTION

It is an object of the present invention to enable single-handed parting engagement of a sheet conveying unit sheet conveyor pair that can travel through a swinging movement, moreover such that sheets jammed in the course of conveyance through the sheet conveying unit are easily removed single-handedly.

A sheet conveying unit according to the present invention conveys sheets inside an image forming apparatus. This unit comprises a main frame, a sheet storing section, a lower conveying section, an upper conveying section, and a first link member. The main frame is fit in the image forming apparatus so that it is withdrawable frontward across the direction of sheet conveyance. The sheet storing section is provided in the main frame. The lower conveying section has a lower conveying guide, one end of which is pivotably supported on the main frame, disposed above the sheet storing section, and a lower conveying element circulatingly supported upon the lower conveying guide. The upper conveying section has an upper conveying guide disposed above the lower conveying section, one end of which is pivotably supported on the main frame, disposed above the lower conveying section, and an upper conveying element that is circulatingly supported upon the upper conveying guide and conveys sheets to the sheet storing section, together with the lower conveying guide. One end of the first link member is rotatably fit to one of the upper and lower conveying guides, and the other end is engaged with the other conveying guide such that the two conveying guides turn linked and spaced at predetermined intervals and lock at the predetermined intervals.

In this unit, when a sheet jam occurs between the upper and lower conveying sections, the main frame is drawn frontward and the upper conveying section is lifted and turned single-handedly. When the upper and lower conveying sections subsequently turn into predetermined spaced intervals, both sections lock at predetermined intervals due to the configuration of the first link member. In this situation, the upper conveying section will not fall back to its original position though the hand is taken away from the upper conveying section. It is therefore easy single-handedly to clear sheets jammed between either section. When the upper conveying section is further lifted and turned, due to the locking engagement of both sections by means of the first link member, the lower conveying section turns linked with the upper conveying section, such that the area over the sheet storing section is opened. Therefore, if a sheet jam occurs in the sheet storing section, access to clear the jammed sheet is merely by turning open the upper conveying section.

Alternatively, the other of the upper and lower conveying guides to which the first link member is not fit may have an engaging element. The first link member may herein include a plate-shaped link main body, a fitting that is provided on one end of the link main body and pivotably fit in aforesaid other of the upper and lower conveying guides, and an L-shaped slot for engagement with the engaging element of said other conveying guide. The L-shaped slot is formed as a first slot portion extending radially away from a position apart from the fitting and a second slot portion extending circumferentially from the first slot portion. The L-shaped slot is thus configured such that such the link main body can turn on the engaging element and drops under its own weight.

With this construction, wherein the fitting is fit to the upper conveying section and the engaging element is provided in the lower conveying section, when the upper conveying section is lifted and turns thereby, the first slot portion is engaged by the engaging element, turning the first link member, whereby the engaging element shifts from one end of the first slot portion to the other end. When the engaging element is located at the other end of the first slot portion wherein the two conveying sections are spaced apart at the predetermined interval, the engaging element locates in the circumferentially formed second slot portion, such that the link main body turns further about the fitting under its own weight. Since at that point the engaging element is located at the end of the second slot portion and cannot move radially, the two conveying section are locked. As a result, after removing the hand from it in this state the upper conveying section neither itself turns, nor brings about further turning of its associated components. It is therefore easy single-handedly to clear a sheet jam that has occurred between the upper and lower conveying sections.

Subsequently, by turning the upper conveying section further, the lower conveying section turns linked with the upper conveying section, with the second slot portion positioned circumferentially engaging the engaging element. As a result, the area above the sheet storing section is opened, enabling clearance of sheets jammed in the sheet storing section.

Accordingly a simple construction, i.e., the first link member having the L-shaped slot and thus configured to turn under its own weight, enables the two conveying sections to turn in tandem and lock in to predetermined positions.

The upper and lower conveying elements may have mutually opposed upper and lower conveyor rollers rotatably fit into the upper and lower conveying guides, respectively. The upper and lower conveyor rollers thus pinch sheets in conveyance, and accordingly prevents the sheets from being contaminated due to foreign matter such as attached toner.

Either of the upper and lower conveying sections may further have a pressing element for pressing the corresponding one of the upper and lower conveyor rollers against the other. This ensures that the sheets in conveyance are held securely between the upper and lower conveyor rollers, thereby making the sheet conveyance more reliable.

The sheet storing section may be an intermediate tray that is used in turning over sheets the obverse side of which has been once-printed or otherwise image-reproducing processed and similarly processing the reverse side. In this case as well the upper and lower conveying sections can be turned linked to lock open for access to the intermediate tray in the event of a sheet jam therein.

Alternatively, the sheet conveying unit according to the invention in its present aspect may be further provided with a second link member. One end of the second link member is pivotably fit onto one of the lower conveying guide and the main frame, and the other end of the second link member is engaged with the other of these. With this construction, when the upper conveying section is turned by lifting, the two conveying sections are locked by the first link member. When the upper conveying section is further turned, the lower conveying section turns linked with the turning of the upper conveying section, because the two conveying sections are locked by the first link member. Subsequently, the main frame and the lower conveying section are locked by the second link member, wherein no further turning arises. Herein, since the two conveying sections and main frame are all locked, in the event of a sheet jam between the two conveying sections or in the sheet storing section, the jammed sheets can be removed single-handedly, expediting sheet clearance.

According to another aspect of the present invention, a sheet conveying unit for conveying sheets inside an image forming apparatus comprises a main frame, a sheet storing section, a lower conveying section, an upper conveying section, a lock mechanism, and a support mechanism. The main frame is fit in an image forming apparatus in such a manner that it is withdrawable frontward across the direction of sheet conveyance. The sheet storing section is provided in the main frame. The lower conveying section is disposed above the sheet storing section and has a lower conveying guide, one end of which is pivotably supported on the main frame, and a lower conveying element circulatingly supported upon the lower conveying guide. The upper conveying element has an upper conveying guide, one end of which is pivotably supported upon the main frame, disposed above the lower conveying section, and an upper conveying guide that conveys sheets to the sheet storing section together with the lower conveying element, circulatingly supported upon the upper conveying guide. The lock mechanism contains a first linkage that can lock the upper conveying element in a predetermined open position at which the upper conveying element is opened out above the sheet storing section. The support mechanism contains a second linkage that supports the lower conveying element so that when the upper conveying element is locked in the open position by the lock mechanism, the lower conveying element is opened above the sheet storing section, spaced at predetermined distances from the upper conveying element and the sheet conveying section, respectively.

In this sheet conveying unit, when the upper conveying element is turned upward to reach the open position, the upper conveying element is locked at a predetermined open position at which the upper conveying element is opened out over the sheet storing section. Meanwhile supported as such, the lower conveying element is brought into position at predetermined distances midway between the upper conveying element and sheet storing section, respectively. This facilitates the process of clearing a sheet jam that has occurred in the sheet conveyance path formed between the upper and lower conveying elements, or between the lower conveying element and the sheet storing section. Accordingly, by a single-handed operation of merely lifting the upper conveying element, both the upper and lower conveying elements can be locked open, thus facilitating sheet jam clearing process.

The lock mechanism may contain an engage pin provided on the main frame, and the first linkage may be formed with a guide slot having a first retaining position for slidably engaging the engage pin and positioning the engage pin when the upper conveying element is in the closed position, a second retaining position for retaining the engage pin when the upper conveying element is in the open position; a first guiding portion for guiding the engage pin from the first retaining position to the second retaining position, and a second guiding portion for guiding the engage pin from the second retaining position to the first retaining position.

With this construction, when the upper conveying element is placed in the closed position, forming a sheet conveyance path together with the lower conveying element, the engage pin is placed in the first retaining position of the guide slot. When the upper conveying element is lifted, the first linkage moves wherein the engage pin is engaged in the first guiding portion of the guide slot, such that the first linkage locks the upper conveying element in the open state, with the engage pin placed in the second retaining position. In returning the upper conveying element to the closed position, the first linkage moves wherein the engage pin is engage in the second guiding portion of the guide slot, and thus the upper conveying element is retained in the closed position, into the state in which the engage pin is placed in the first retaining position.

Alternatively, a pressing element can be added as a locking mechanism. The pressing element presses on the first linkage when the upper conveying element moves from the closed position to the open position, thereby bringing the engage pin into engagement with the first guide slot from the first retaining position wherein the engage pin is held. With this construction, when the upper conveying element is in the closed position, merely lifting the upper conveying element engages the engage pin in the first guide portion of the guide slot and guides the first linkage securely such that the engage pin becomes engaged in the second retaining position, enabling the upper conveying element to be locked in the open position.

Alternatively, the first linkage may be configured to rotate under its own weight causing the upper conveying element to turn further upward when the upper conveying element is in the open position, such that the engage pin is brought into engagement with the second guide slot from the second retaining position. With this construction, by making the upper conveying element turn further upward when it is locked in the open state, engagement between the engage pin and the second retaining position of the guide slot is released, such that the engage pin becomes engaged in the second guide portion. As a result of the engage pin being engaged in the second guide portion, the first linkage is guided into the position at which the engage pin is engaged into the first retaining position, and the first linkage then turns linked. This ensures the release of the locking of the upper conveying element, and after the jam clearing process enables the upper conveying element to return readily to the operative state.

Alternatively, the support mechanism may contain an engage pin provided in the lower conveying element, and one end of the second linkage may be pivotably supported on the upper conveying element, and the other end may have a slot for engagement with the engage pin. With this construction, when the upper conveying element is locked in the open state, the lower conveying element is brought into the open state at the same time, spaced at predetermined distances apart from the upper conveying element and the sheet storing section, respectively. Herein, as the upper conveying element is turned, the lower conveying element parts from the upper conveying element under its own weight, and it is retained in the open position in a state wherein the engage pin is engaged in the edge of the slot provided in the second linkage. The open position of the lower conveying element is adjustable, depending on the dimension in the longitudinal direction of the slot and the installation positions of the second linkage and the engage pin. This enables the lower conveying element to be retained in the open position, without need of a complicated structure.

The foregoing and other objects, features, aspects and advantages of the present invention will become more apparent from the following detailed description in conjunction with the accompanying drawings.

DETAILED DESCRIPTION OF THE PREFERRED EMBODIMENTS

Figure 1:
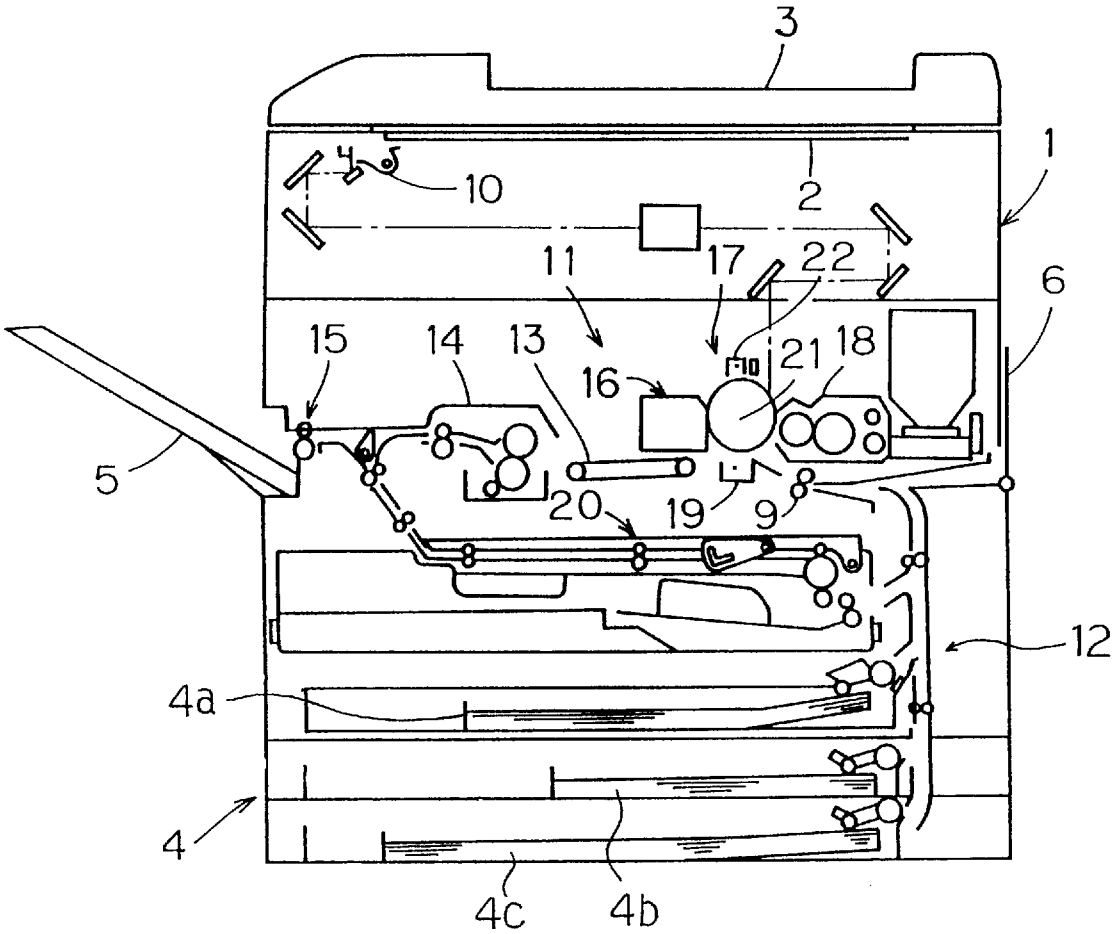
FIG. 1 is a schematic elevational section of a copying machine adopting a preferred embodiment of the present invention.

A photocopier as an electrostatographic example of a printing device in which the present invention in a principal embodiment may be employed is illustrated in FIG. 1. A copying machine main body 1 comprises the overall structure, including a document table 2 on which originals are positioned, disposed in the upper surface of the copying machine main body 1. Original documents can be automatically supplied to the document table 2 by an automatic document feed unit 3 hinge-mounted on the document table 2. A sheet supply unit 4 is furnished in the bottom portion of the copying machine main body 1. A sheet discharge tray 5 for receiving copier-processed sheets discharged from the left portion of machine main body 1 as viewed in FIG. 1. A sheet feed tray 6 for manual feed is hinge-mounted to the right portion.

Disposed inside the copying machine main body 1 are a document reading unit 10 for reading image information from a document situated on the document table 2, an image-forming unit 11 under the document reading unit 10, and a sheet-feeding unit 12 under the image-forming unit 11. The image-forming unit 11 transfers toner developed images onto sheets fed from the sheet-feeding unit 12. A sheet discharging unit 13, a fixing unit 14 for fixing the formed toner images onto the sheets, and discharge rollers 15 for discharging print-finished sheets to the sheet discharge tray 5, are provided in that order on the downstream side of the image-forming unit 11 in terms of the sheet conveyance direction from the copy sheet feeding end to the print-finished sheet discharge end of the copying machine main body 1.

A dual-sided copying section 20 that turns over sheets onto which toner images have been transferred during the dual-sided copying process is unit 11 between the image-forming unit 11 and the sheet feeding unit 12. Resist rollers 9 that determine the timing of copy sheet conveyance from the sheet-feeding unit 12 to the image-forming unit 11 are disposed on the upstream side thereof in the sheet conveyance direction.

The sheet supply unit 4 includes vertically disposed sheet supply cassettes 4*a,* 4*b* and 4*c,* each withdrawable toward the near side of the photocopier, i.e. frontward, as viewed in FIG. 1.

The image-forming unit 11 comprises a drum unit 16 containing a photosensitive drum 21, on the surface of which electrostatic latent images are formed in response to image information read by the document reading unit 10; a primary charging unit 17 containing a main charger 22; a developing unit 18 for toner-developing the electrostatic latent images; and a transfer charger 19 for transferring the developed toner images onto copy sheets.

Figure 2:
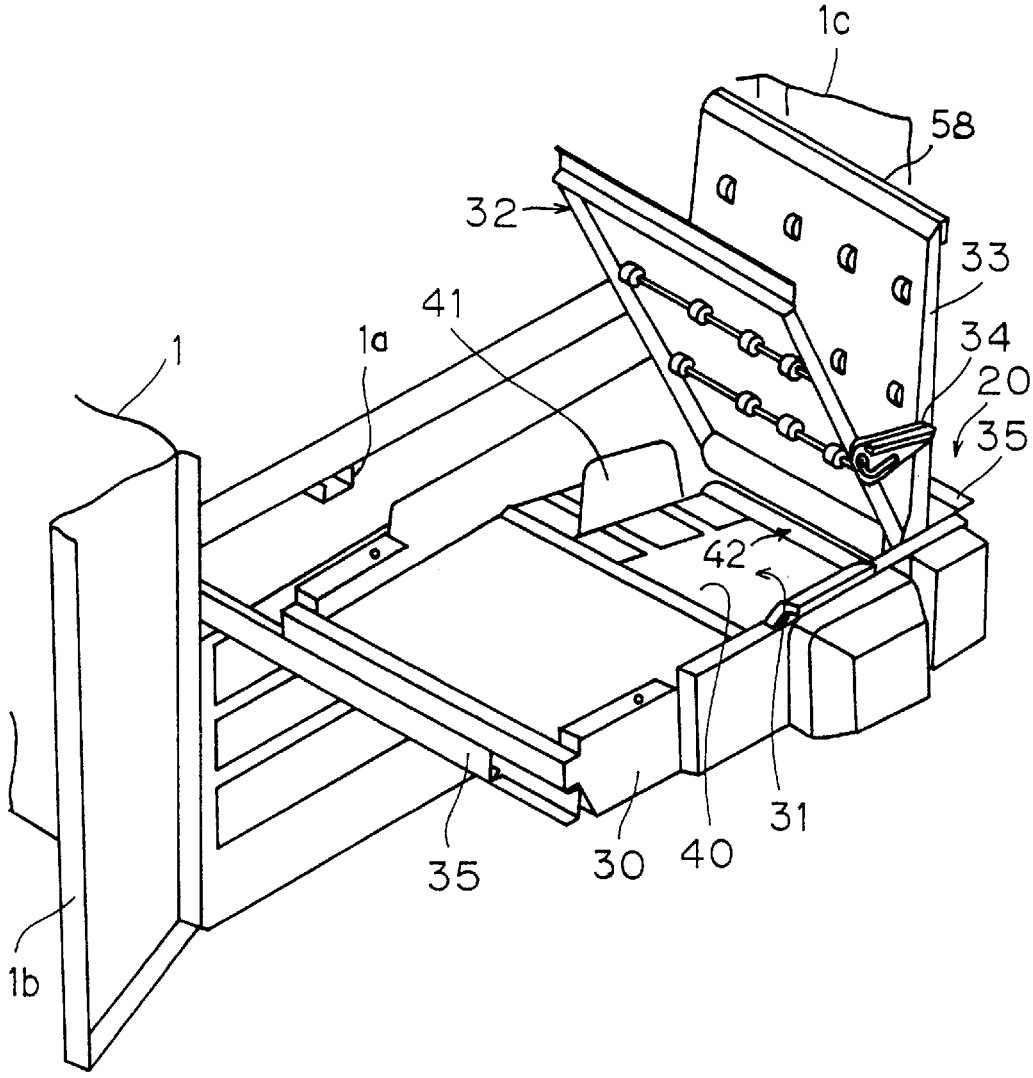
FIG. 2 is an orthographic view of a situation in which a dual-sided copying section of the copying machine is withdrawn.
Figure 3:
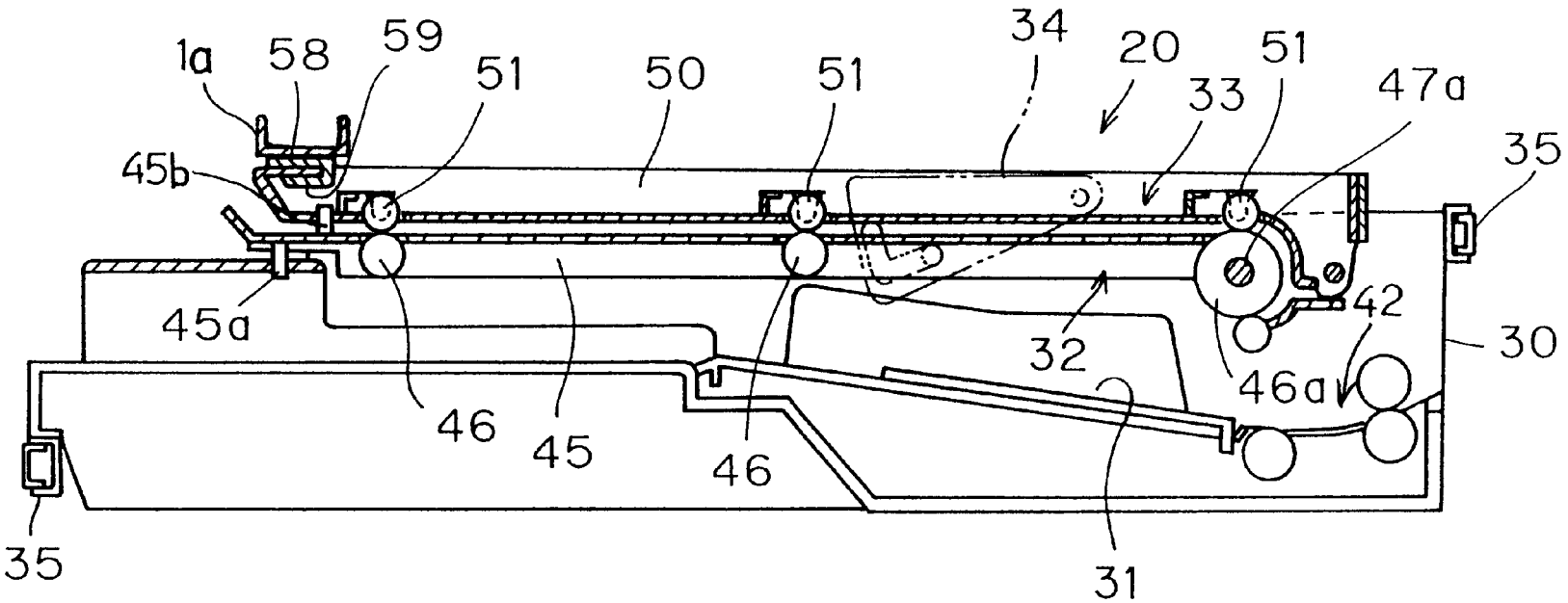
FIG. 3 is an elevational section of the dual-sided copying section.

Referring to FIGS. 2 and 3, the dual-sided copying section 20 comprises a main frame 30 that is withdrawable toward the near side as shown in the FIG. 2 view, an intermediate tray 31 disposed inside of the main body frame 30, a lower conveyor 32 disposed above the intermediate tray 31, an upper conveyor 33 disposed above the lower conveyor 32, and a linkage 34 for linking the lower conveyor 32 and the upper conveyor 33.

The main frame 30 is supported on two guide rails 35 extending with respect to the copying machine main body 1 such that the main frame 30 is withdrawable frontward from the main body 1. The intermediate tray 31 comprises a document storing section 40 that can contain a plurality of the once-printed copy sheets it serves temporarily to store; a width registration element 41 for registering the temporarily stored copy sheets widthwise according to size; and a convey-out unit 42 for sending out the stored sheets one by one.

The lower conveyor 32 comprises a lower conveying guide 45 and three lower convey rollers 46, 46, 46*a* rotatably supported on the lower conveying guide 45 and spaced at intervals in the conveyance direction. Lower convey roller 46*a* is disposed to the right as viewed in FIG. 3, on a drive shaft 47*a* transverse to the sheet conveyance direction. The lower conveying guide 45 is pivotably supported onto the main frame 30 about the drive shaft 47*a*. By a positioning pin 45*a*, the conveying guide 45 is positioned in its two planar directions with respect to the main frame 30.

The two lower convey rollers 46 to the left in FIG. 3 are of small diameter relative to the larger-diameter lower convey roller 46*a* to the right. The larger diameter lower convey roller 46*a* is driven by a motor (not shown), torque from which is transmitted to the two smaller diameter lower convey rollers 46 through a chain (not shown).

Figure 4:
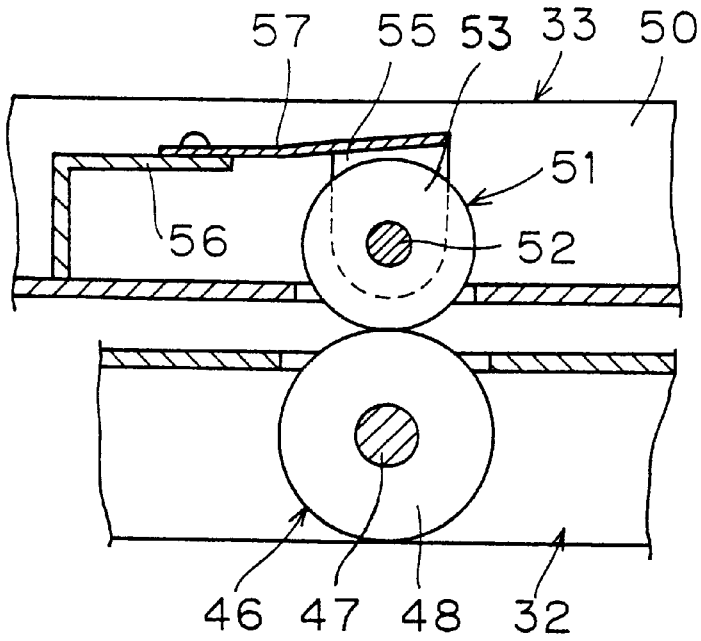
FIG. 4 is a grossly enlarged sectional view of conveyor rollers.
Figure 5:
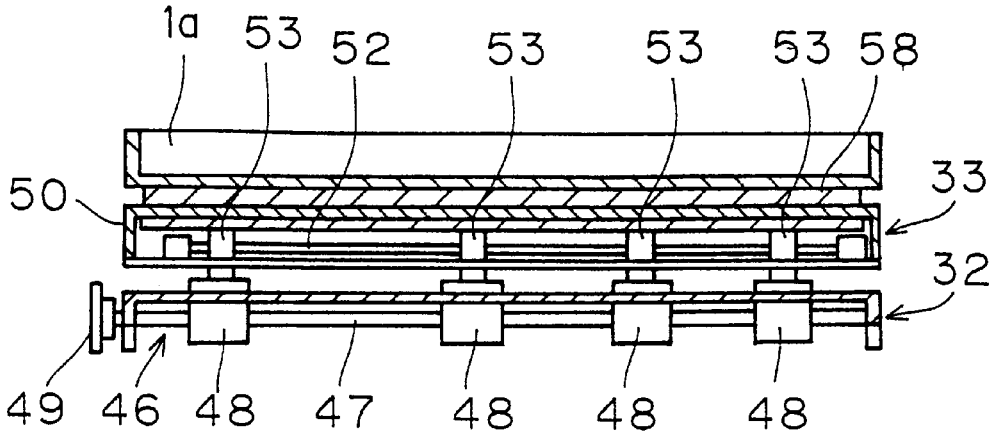
FIG. 5 is a transverse section of a distal end of a conveyor.

As shown in FIGS. 4 and 5, the rollers 46, 46 run transverse to the conveyance direction, riding on drive shafts 47, and together with roller 46*a* each comprise four wheels 48 mounted on the respective drive shafts 47 and 47*a* spaced intervals in accordance with sheet size. A sprocket 49 for the drive chain is fit on the rear (on the left in FIG. 5) of the drive shaft 47.

The upper conveyor 33 comprises an upper conveying guide 50 and three upper convey rollers 51 rotatably supported upon the upper conveying guide 50. The conveying guide 50 is pivotably supported on the main frame 30 on the rotational center of the lower conveying guide 45, rightward in the FIG. 3 view. Copy sheets are guided in the space between the upper conveying guide 50 and the lower conveying guide 45, turned over by the lower conveyor roller 46*a*, and then conveyed to the intermediate tray 31.

As shown in FIG. 5, the upper convey rollers 51 are located opposing the lower convey rollers 46, 46, 46*a*, and each has an axle 52 on which four wheels 53 are mounted at spaced intervals. Thus the wheels 53 of the upper conveying guide 50 are disposed such that they ride on the wheels 48 of the lower conveying guide 45.

As shown in FIG. 4, disposed on either end of each axle 52 are brackets 55 on which the axle 52 is rotatably supported. The brackets 55 are mounted through a plate spring 57 on an L-shaped bracket 56 fixed to the upper conveying guide 50. The plate spring 57 urges each upper convey roller 51 downward into pressure contact with the lower convey rollers 46, 46, 46*a*.

A grip 58 used to take hold of and raise the upper conveyor 33 is fit into the other end of the upper conveying guide 50. The other end of the conveying guide 50 is positioned in its two horizontal planar directions by a positioning pin 45*b* (FIG. 3) provided in the lower conveying guide 45.

Figure 6:
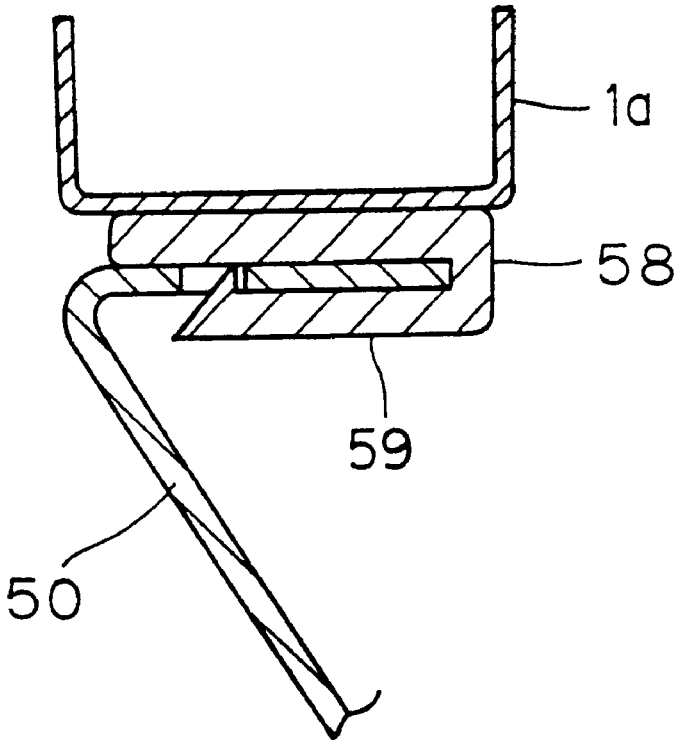
FIG. 6 is a grossly enlarged sectional view of a proximal end of an upper conveyor.

The grip 58 is made of a synthetic resin, such as polyacetal resin or nylon resin, and as shown in FIG. 6 is a U-shaped element having approximately the same length as the depth dimension of the upper conveyor 33. The bottom surface of the grip 58 has grasping portion 59 into which an operator's fingertips can be placed. When the dual-sided copying section 20 is reinserted into the main body 1, the upper surface of the grip 58 is brought into contact with a stay 1*a* provided in the copying machine main body 1. When the main frame 30 is housed within the main body 1, the stay 1*a* vertically positions the upper conveyor 33 and lower conveyor 32. Accordingly, with the upper convey roller 51 urged by the plate spring 57, the upper and lower convey rollers 46, 46, 46*a* and 51 will not part from one another, such that copy sheets are conveyed while being pinched by the two convey roller sets 46, 51.

Figure 7A:
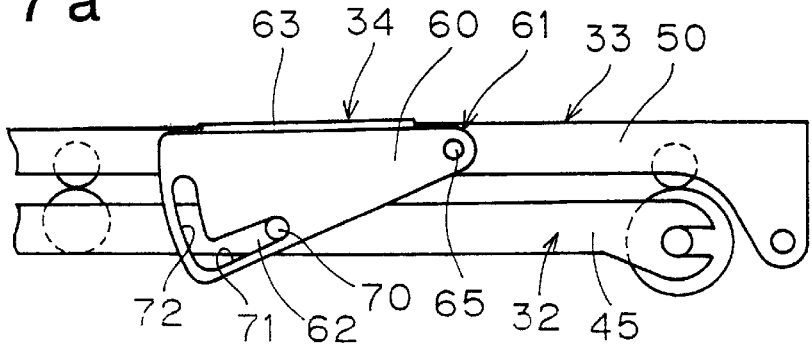
FIGS. 7(*a*) to 7(*c*) are diagrammatical views for explaining the opening/closing operation of the upper conveyor.
Figure 7B:
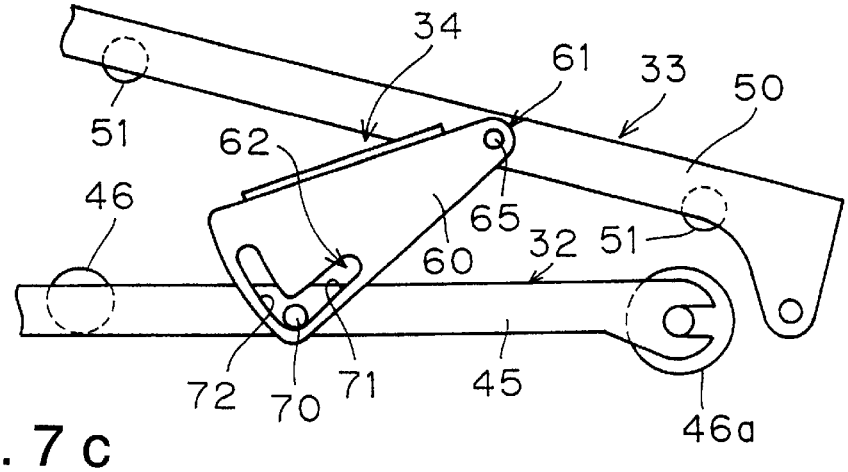
Figure 7C:
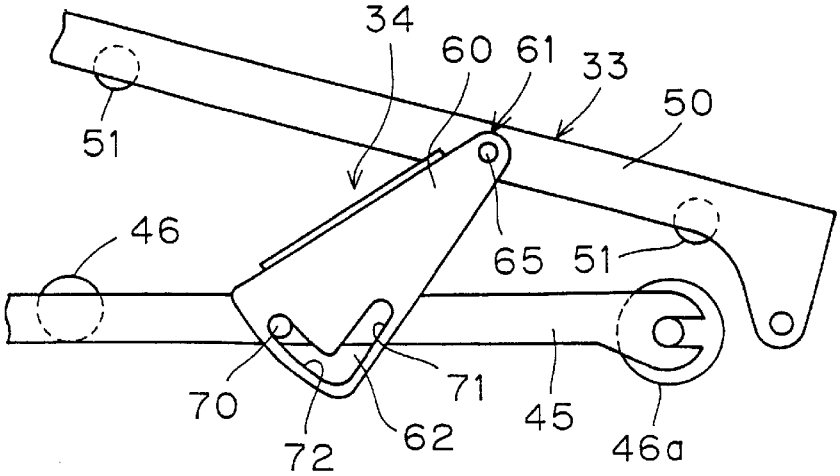
Figure 8:
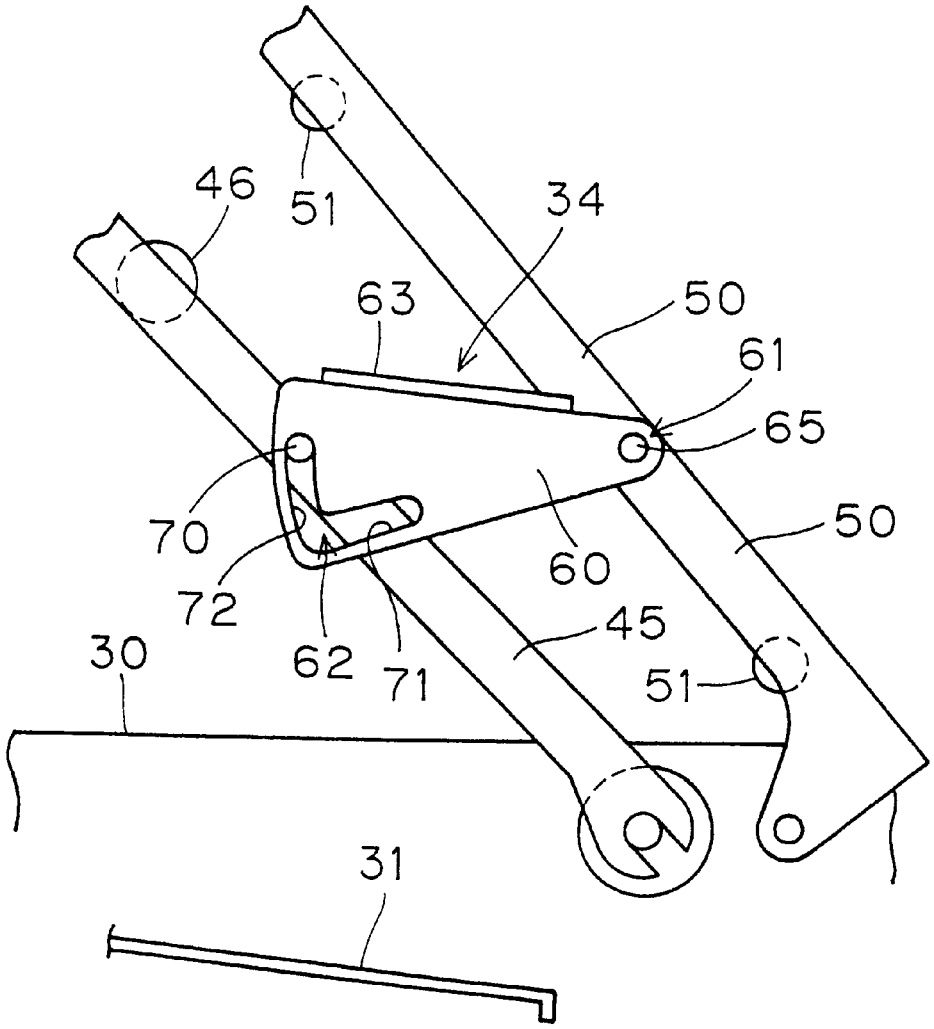
FIG. 8 is a diagrammatical view of a situation wherein the upper conveying section is further opened/closed.

Referring to FIGS. 7(*a*) to 7(*c*), the linkage 34 has a link main body 60; a fitting 61 formed on one end of the link main body 60; an L-shaped slot 62 formed in the other end of the link main body 60; and a grip portion 63 bent frontward from the upper edge of the link main body 60. The link main body 60 is a fan-shaped plate element and is pivotably supported on the base end of the upper conveying guide 50 of the upper conveyor 33 by the fitting 61. The fitting 61 is pivotably supported on a turning pin 65 provided on a lateral frontward surface of the upper conveying guide 50. The lower conveying guide 45 of the lower conveyor 32 is provided with an engage pin 70 projecting frontward and somewhat more prominently than the rotation pin 65. The engage pin 70 is engaged into L-shaped slot 62. From the vertex of the L-shaped slot 62 a first slot portion 71 extends in the radial direction of the link main body 60, and a second slot portion 72 extends circumferentially, from the adjoining end of the first slot portion 71. The engage pin 70 is located into the distal end of the first slot portion 71 from the vertex of L-shaped slot 62 in the situation wherein the two conveyors 32, 33 are stowed into place.

Description will be now given of the operation when a sheet jam occurs in a dual-sided copying section 20 thus constructed.

The fact that a sheet jam has occurred in the dual-sided copying section 20 is indicated by a display section on the upper surface of the copying machine main body 1. Thereupon, the operator opens bipartite doors 1*b*, 1*c* (FIG. 2) provided on the front face of the body 1, and withdraws the dual-sided copying section 20 frontward. The copying section 20 is normally locked in the body 1 by a lock mechanism (not shown). It is therefore necessary to release the lock mechanism before the dual-sided copying section 20 is drawn out. In the event of a sheet jam between the lower conveyor 32 and the upper conveyor 33, grip 58 is initially grasped, and the upper conveying guide 50 is lifted to turn the dual-sided copying section 20, as shown in FIG. 7(*b*). At this time, since engage pin 70 is engaged into the first slot 71 of linkage 34, the linkage 34 rotates counterclockwise as viewed in FIGS. 7(*a*) to 7(*c*). As shown in FIG. 7(*b*), when the engage pin 70 reaches the end of the first slot 71, since the second slot 72 is formed circumferentially, the linkage 34 rotates further in counterclockwise under its own weight, thereby becoming located into the position shown in FIG. 7(*c*). As a result, the linkage 34 is engaged on the engage pin 70 and the two conveying guides 45, 50 are locked. In this state, the upper conveying guide 50 may not turn downward, such that jammed sheets can be easily removed single-handedly.

In the event of a sheet jam on intermediate tray 31, the upper conveying guide 50 is lifted by grasping the grip 58. The lower conveying guide 45 is then turned into the situation wherein it is locked with the upper conveying guide 50 by the linkage 34. As a result, the area above the intermediate tray 34 is opened, such that the sheet jam therein can be cleared easily. To release the lock, for instance, with the grip 58 grasped by the left hand and the grip portion 63 of the linkage 34 grasped by the right hand, the linkage 34 is rotated clockwise as viewed in FIGS. 7(*a*) to 7(*c*), to locate the engage pin 70 in the corner of the L-shaped slot 62, as shown in FIG. 7(*b*).

Meanwhile, wherein the main frame 30 is housed within the copying machine main body 1, the grip 58 is brought into contact with the stay la so that the upper conveyor 33 and the lower conveyor 32 are vertically positioned. This keeps the upper conveyor 33 from rising even with a high-compression plate spring 57.

In addition, since the grip 58 is disposed on the tip end of the upper conveying guide 50, whose basal portion is supported, the upper conveyor 33 is lifted completely with less force.

Furthermore, since the grip 58 is made of a synthetic resin, e.g., polyacetal resin, its corners are made smooth, making it easy to grasp, compared to grips made of metal. This also reduces frictional resistance with the grip 58 in contact with the stay 1*a*, providing smooth movement of the main frame 30.

Figure 9A:
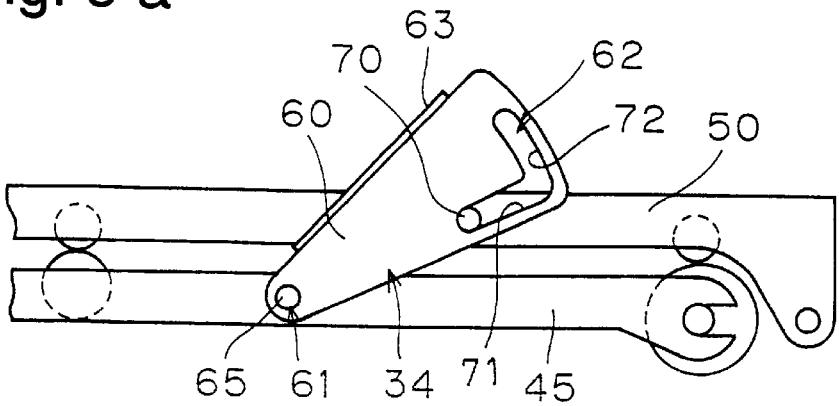
FIGS. 9(*a*) and 9(*b*) are diagrams for explaining opening/closing operation of an upper conveyor according to another aspect of the preferred embodiment.
Figure 9B:
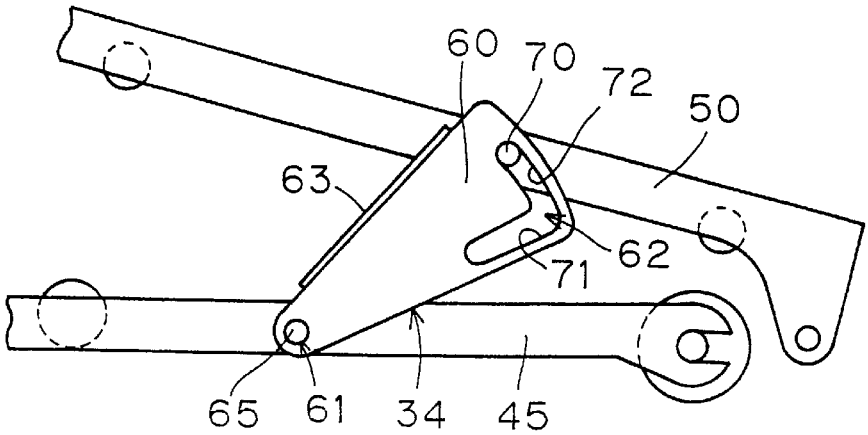

Although in the foregoing embodiment the fitting 61 is formed on the upper conveying guide 50 end, it may be formed on the lower conveying guide 45 end, and the engage pin 70 may be provided on the upper conveying guide 50, as shown in FIGS. 9(*a*) and 9(*b*).

Figure 10:
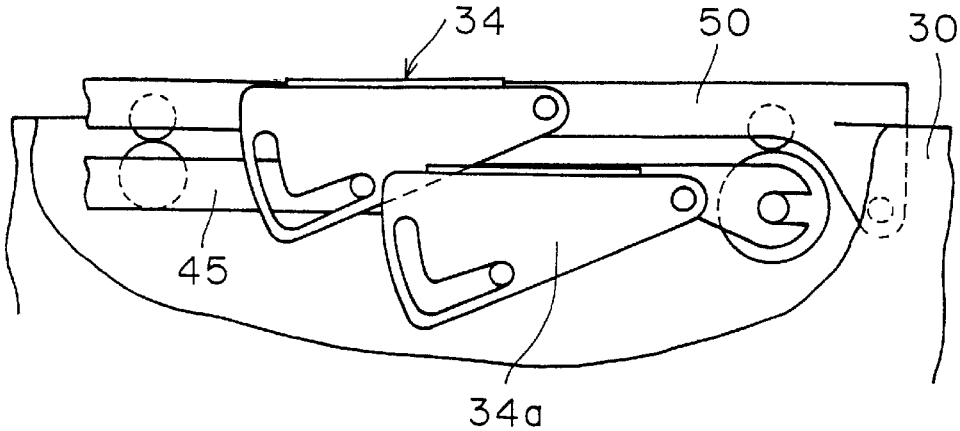
FIG. 10 is a diagram for explaining opening/closing operation of an upper conveyor according to another aspect of the preferred embodiment.

Referring to FIG. 9(*a*), wherein the upper conveying guide 50 is disposed above the lower conveying guide 45, linkage 34 is disposed to the right and upward. Referring to FIG. 9(*b*), when the upper conveying guide 50 is lifted with the grip 58 grasped, and the engage pin 70 reaches the end of first slot 71, since second slot 72 is formed circumferentially, the linkage 34 pivots clockwise as viewed in FIGS. 9(*a*) and 9(*b*); thereby the two conveying guides 45, 50 are locked. To release the lock, the linkage 34 may be turned counter-clockwise as viewed in FIGS. 9(*a*) and 9(*b*), by grasping the grip portion 63, as previously described. Referring to FIG. 10, main frame 30 may be linked with a lower conveying guide 45 by means of a linkage 34*a* having the same structure as a linkage 34. With the upper conveying guide 50 and lower conveying guide 45 locked, the upper conveying guide 50 is further lifted so as to place the lower conveying guide 45 in a predetermined rotational position, thereby the lower conveying guide 45 and the main frame 30 are locked. Here, the lower conveying guide 45 is not allowed to turn further, and therefore it is difficult to open the intermediate tray 31 widely. In this embodiment, when a sheet jam occurs in the intermediate tray 31, the main frame 30 and the lower conveying guide 45 are both locked, enabling single-handed removal of jammed sheets.

A sheet conveying unit according to another embodiment of the present invention will be described with reference to FIGS. 11 to 17.

A sheet conveying unit of the second preferred embodiment is applied to a similar copying machine as in the first preferred embodiment, and a lock mechanism 80 and a support mechanism 81 are provided instead of the linkage 34 illustrated in FIGS. 2 and 3. In FIGS. 11 to 17, like parts are identified by the same reference numerals as in the above-described embodiments, and therefore description is omitted here.

Figure 11:
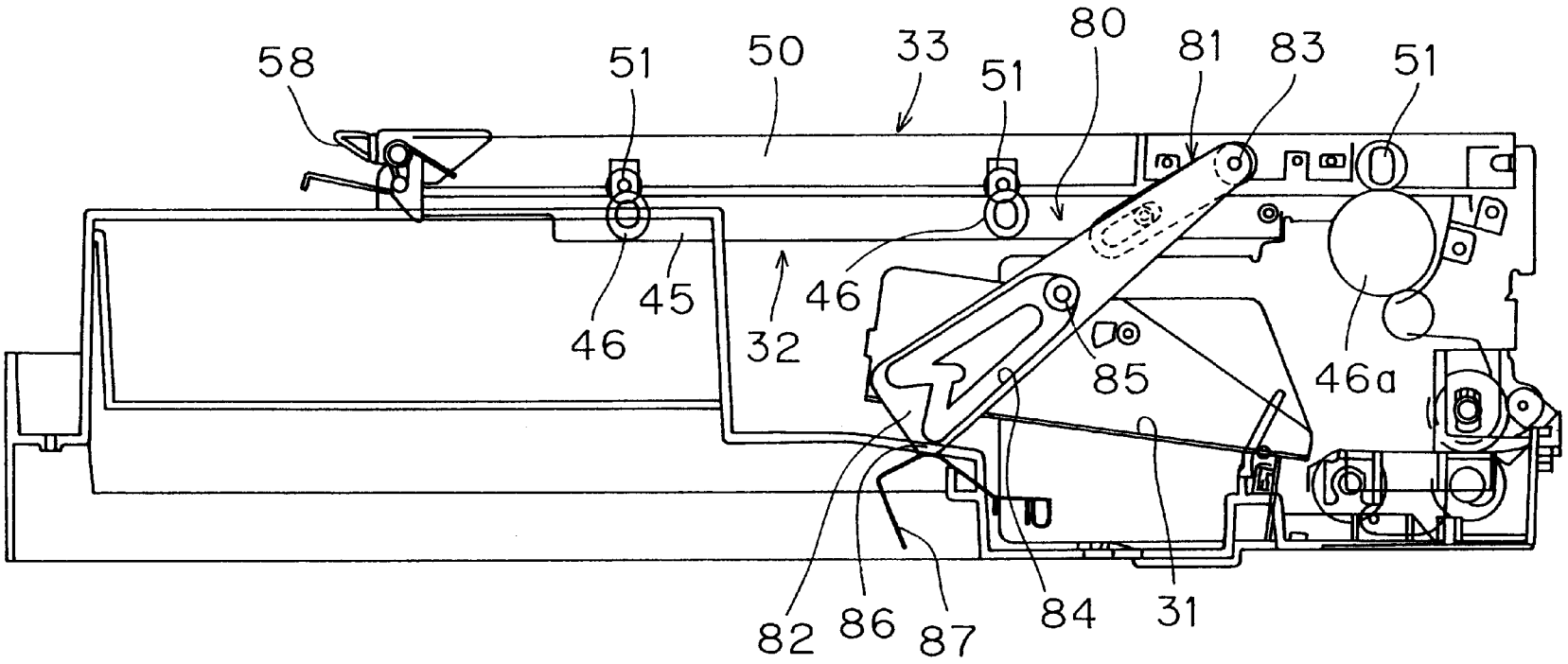
FIG. 11 is a transverse section of a sheet conveying unit according to a another embodiment of the present invention.

The lock mechanism 80 has a first linkage 82 that is rotatably mounted in the upper conveying guide 50 of upper conveyor 33. The first linkage 82 is supported upon a support shaft 83 projecting through the upper conveying guide 50 so that it is free to rotate around the support shaft 83. The first linkage 82 has a substantially heart-shaped guide slot 84. An engage pin 85 disposed on the main frame body 30 is engaged in the guide slot 84. As shown in FIG. 11, a spring element 87 is provided on the main frame 30 side. The spring element 87 abuts a lower end 86 of the first linkage 82 to urge the member 82 upward in a situation where upper and lower conveyors 33, 32 form a sheet conveyance path in their closed state.

Figure 13:
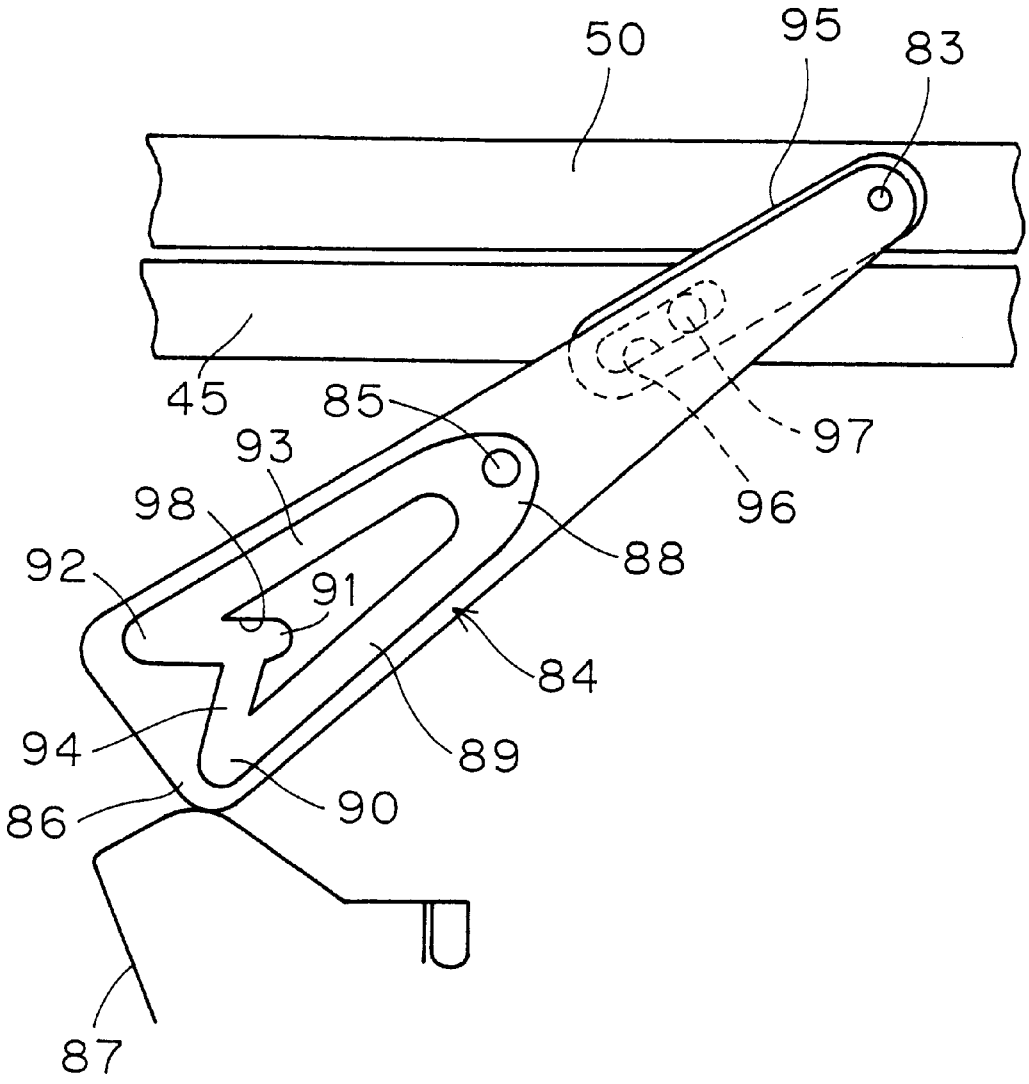
FIG. 13 is a diagram for explaining operation of the conveying guide.

Referring to FIG. 13, the guide slot 84 comprises a first holding portion 88 that engages the engage pin 85 when the upper conveying guide 50 is in the closed state, a first guide portion 89 extending from the first holding portion 88 to the left and downward as-viewed in FIG. 13, a position regulating portion 90 located in a lower end of the first guide portion 89, a lock guide portion 94 extending upward from the position regulating portion 90, a second holding portion 91 that holds the engage pin 85 in the locked state when the upper conveying guide 50 is in the open state, a position regulating portion 92 extending from the second holding portion 91 to the left side as viewed in FIG. 13, and a second guide portion 93 extending from the position regulating portion 92 to the first holding portion 88.

The support mechanism 81 is provided with a second linkage 95 rotatably supported on the upper conveying guide 50. One end of the second linkage 95 is supported on an axle 83, as likewise is the first linkage 82, such that they are supported to be pivotable against the upper conveying guide 50. The other end of the second linkage 95 is provided with a slot 96 into which the engage pin 97 is engaged, projecting through the lower conveying guide 45.

Figure 12:
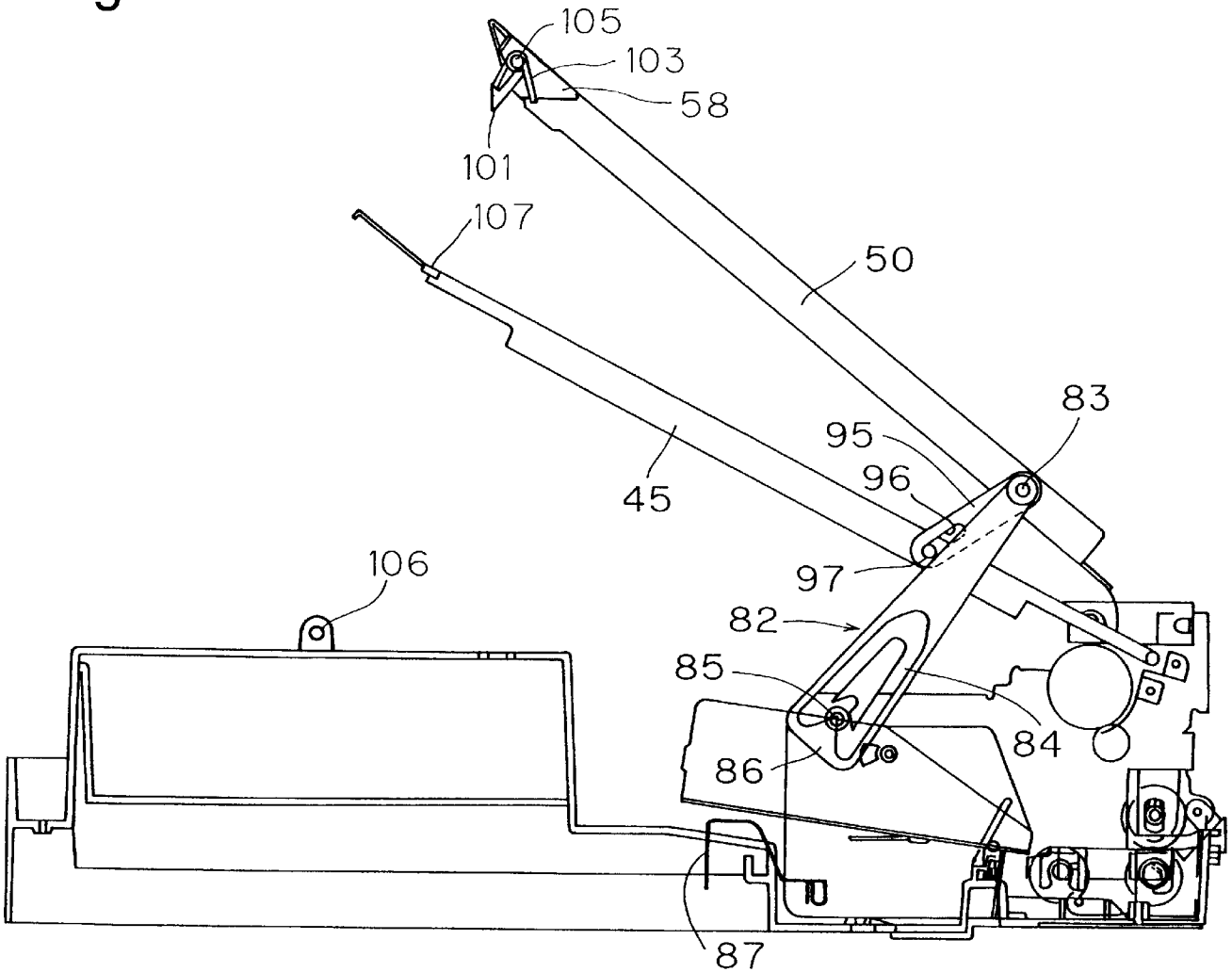
FIG. 12 is a transverse section of the open state of a conveying guide of the sheet-conveying unit.

A positioning mechanism 100 that functions to position the upper and lower conveying guides 50, 45 when in the closed state, is disposed on the free end of the upper conveying guide 50 (on the left in FIG. 11). As shown in FIG. 12, the positioning mechanism 100 has an engagement 101 pivotably supported around a support shaft 105 provided in the upper conveying guide 50, and a spring 103 that urges the engagement 101 around the support shaft 105. On the main frame 30 side, an engage pin 106 is disposed that is engaged in the engage member 101 when the upper conveying guide 50 is in the closed state. With this construction, when the upper conveying guide 50 is in the closed state, the engage member 101 is engaged on the engage pin 106, thereby positioning the upper conveying guide 50. On the other hand, the lower conveying guide 45 is provided with a positioning member 107 which positions the lower conveying guide 45 when it is in the closed state.

Operation of A sheet-conveying unit as set forth in the foregoing embodiment will be described with reference to FIGS. 13 to 17.

In the case where an upper conveying guide 50 and a lower conveying guide 45 are in their closed states and they form a sheet conveyance path, the first holding portion 88 in the guide slot 84 of first linkage 82 engages engage pin 85, as shown in FIG. 13. At the sane time second linkage 95 maintains the position engaging engage pin 97 in the substantially upper portion of slot 96. Spring member 87 abuts the lower end 86 of the first linkage 82 whereby it is elastically deformed, such that the first linkage 82 is urged upward.

Figure 14:
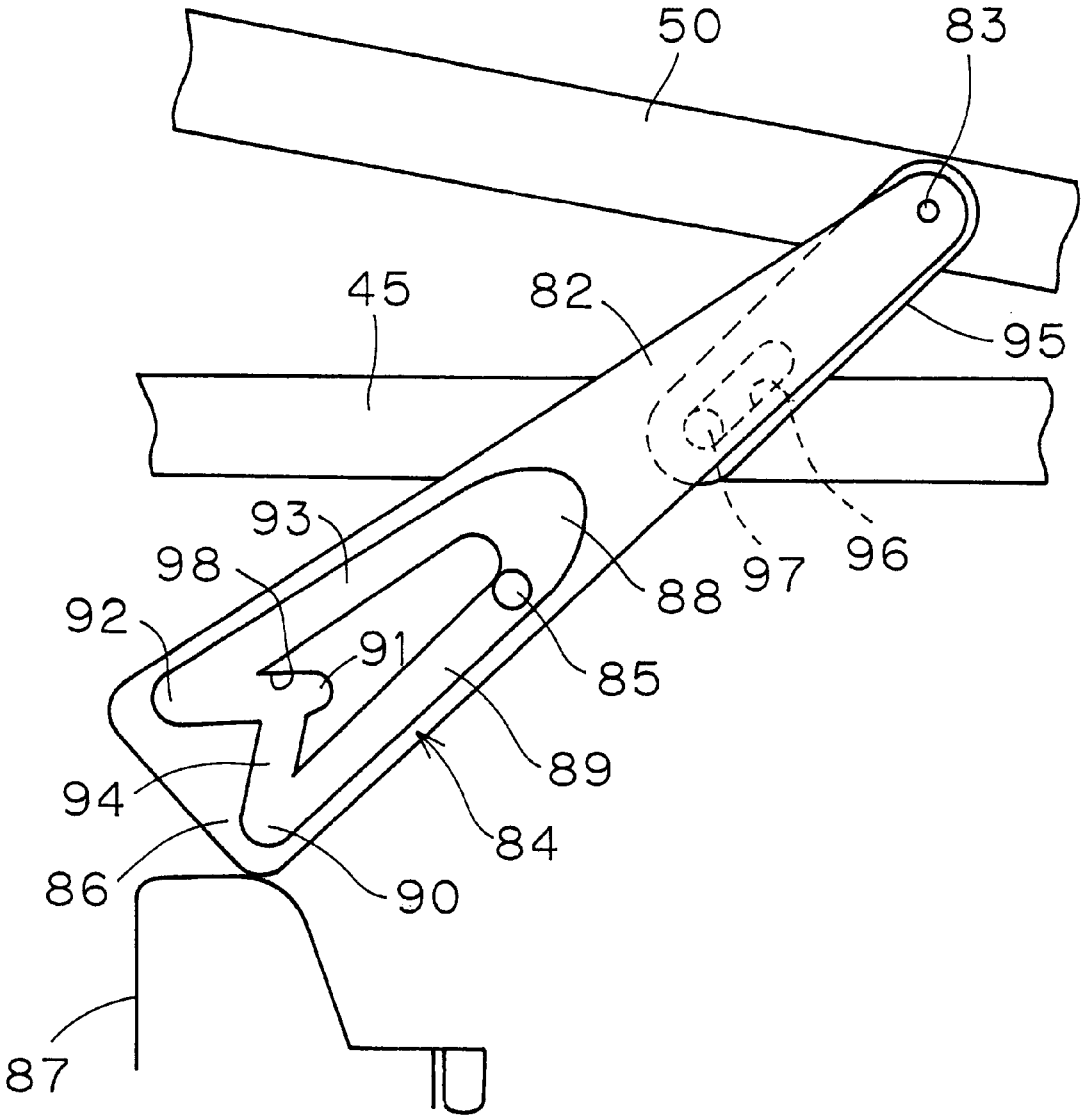
FIG. 14 is another diagram for explaining operation of the conveying guide.

When a sheet jam occurs in the sheet conveyance path, the grip 58 provided on the end of the upper conveying guide 50 is grasped to lift the guide 50, whereby engage member 101 provided on the guide 50 turns against the action of spring 103 to release the engagement with engage pin 106. Since the lower end 86 of the first linkage 82 is urged upward by the spring member 87, the first linkage 82 moves as the upper conveying guide 50 is lifted, such that the first guide portion 89 engages the engage pin 85, as shown in FIG. 14.

As the upper conveying guide 50 is lifted, support axle 83 supporting the second linkage 95 is also lifted and, when the edge of the slot 96 of the second linkage 95 reaches the position of the engage pin 97, the lower conveying guide 45 is lifted at the same time. Herein, one end of the upper and lower conveying guides 50, 45 is lifted, while they are parted from each other at a predetermined distance determined by the second linkage 95.

Figure 15:
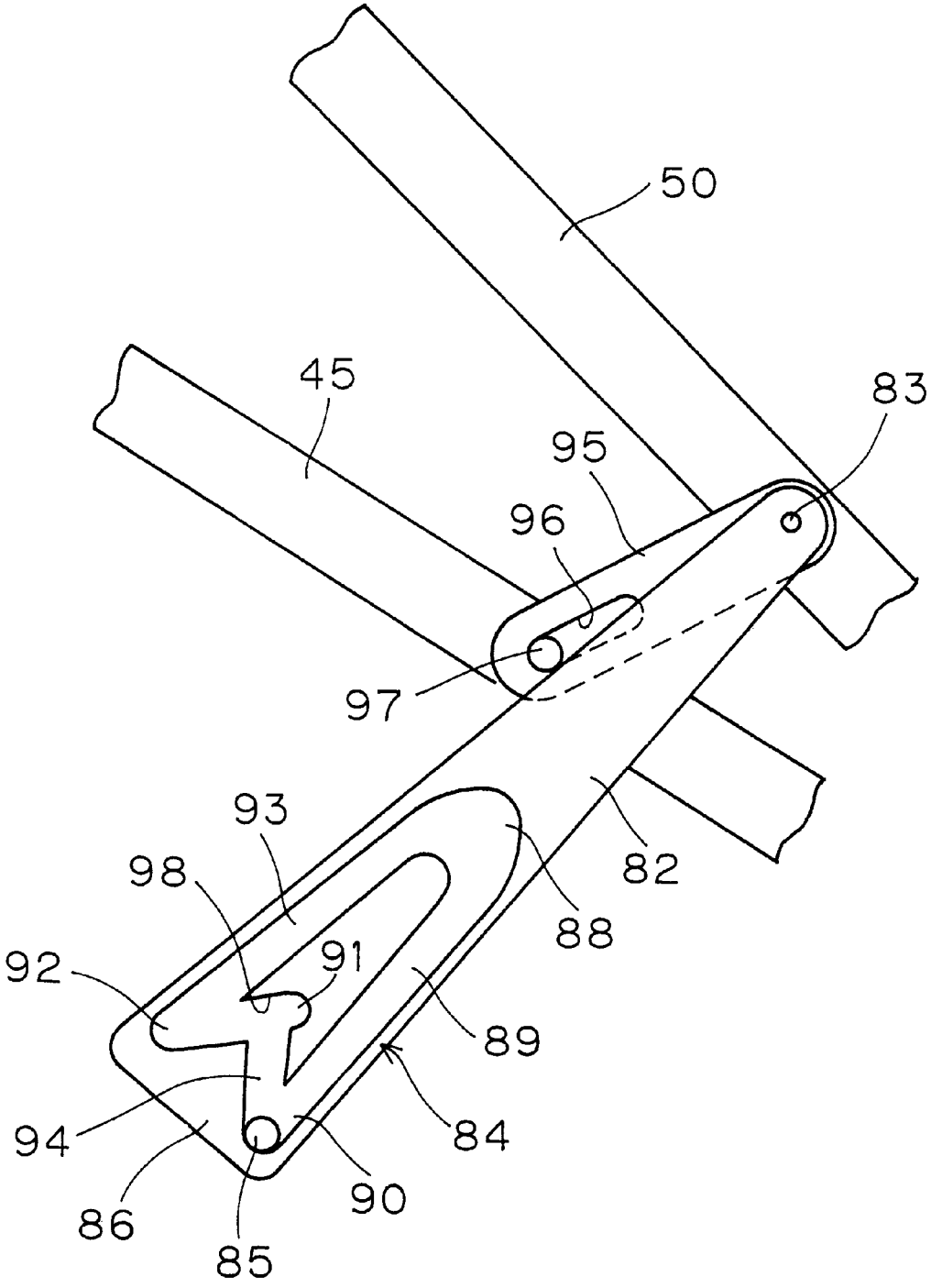
FIG. 15 is another diagram for explaining operation of the conveying guide.

Referring to FIG. 15, after the upper conveying guide 50 is lifted further, the position regulating portion 90 provided in the guide slot 84 of the first linkage 82 reaches the engage pin 85. This regulates movement of the upper conveying guide 50 in the opening direction to prevent it from being lifted further. Herein, the spring member 87 parts from the lower end 86 of the first linkage 82, whereby the first linkage 82 is freed from the agency of the spring member 87. In this state, if the upper conveying guide 50 is brought down, the first linkage 82 rotates counterclockwise as viewed in FIG. 15 under its own weight around the support shaft 83, which causes a sliding drop of the lock guide portion 94 of the guide slot 84 and the engage pin 85.

Figure 16:
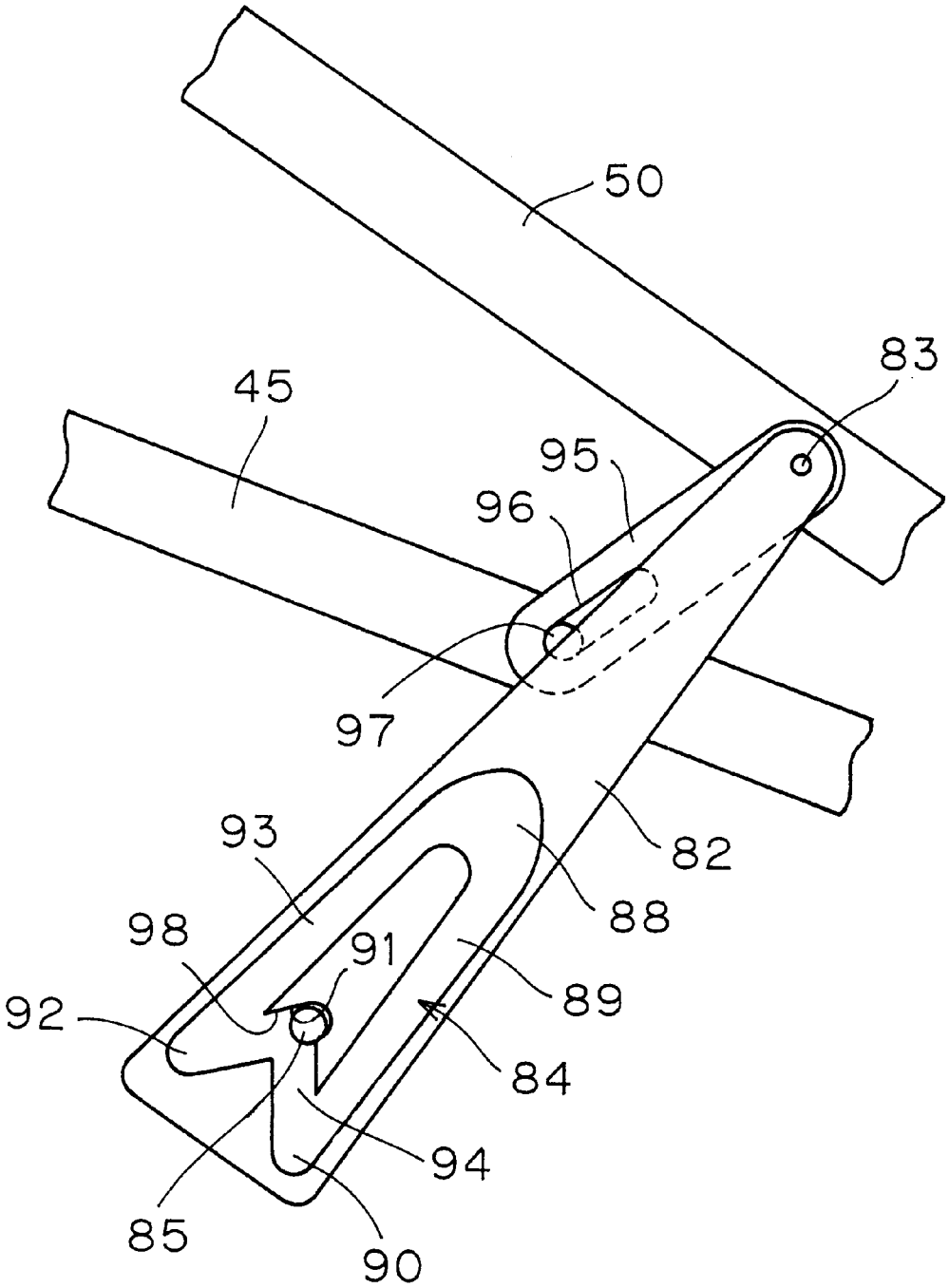
FIG. 16 is another diagram for explaining operation of the conveying guide.

Referring to FIG. 16, when an abutment portion 98 of the lock guide portion 94 of the guide slot 84 abuts on the engage pin 85, the first linkage 82 moves to a position at which the second holding portion 91 engages the engage pin 85, thereby locking the upper conveying guide 50 in the open state at that position. Meanwhile in the second linkage 95, the engage pin 97 is engaged in the edge of the slot 96 to maintain the space between the upper and lower conveying guides 50, 45, at a predetermined distance.

After the sheet jam clearing process, the grip 58 provided in the end of the upper conveying guide 50 is lifted. The first linkage 92 then moves to a position at which the position regulating portion 92 engages engage pin 85, while the first linkage 82 maintains, under its own weight, a state wherein the abutment portion 98 of the guide slot 84 is in contact with the engage pin 85.

Figure 17:
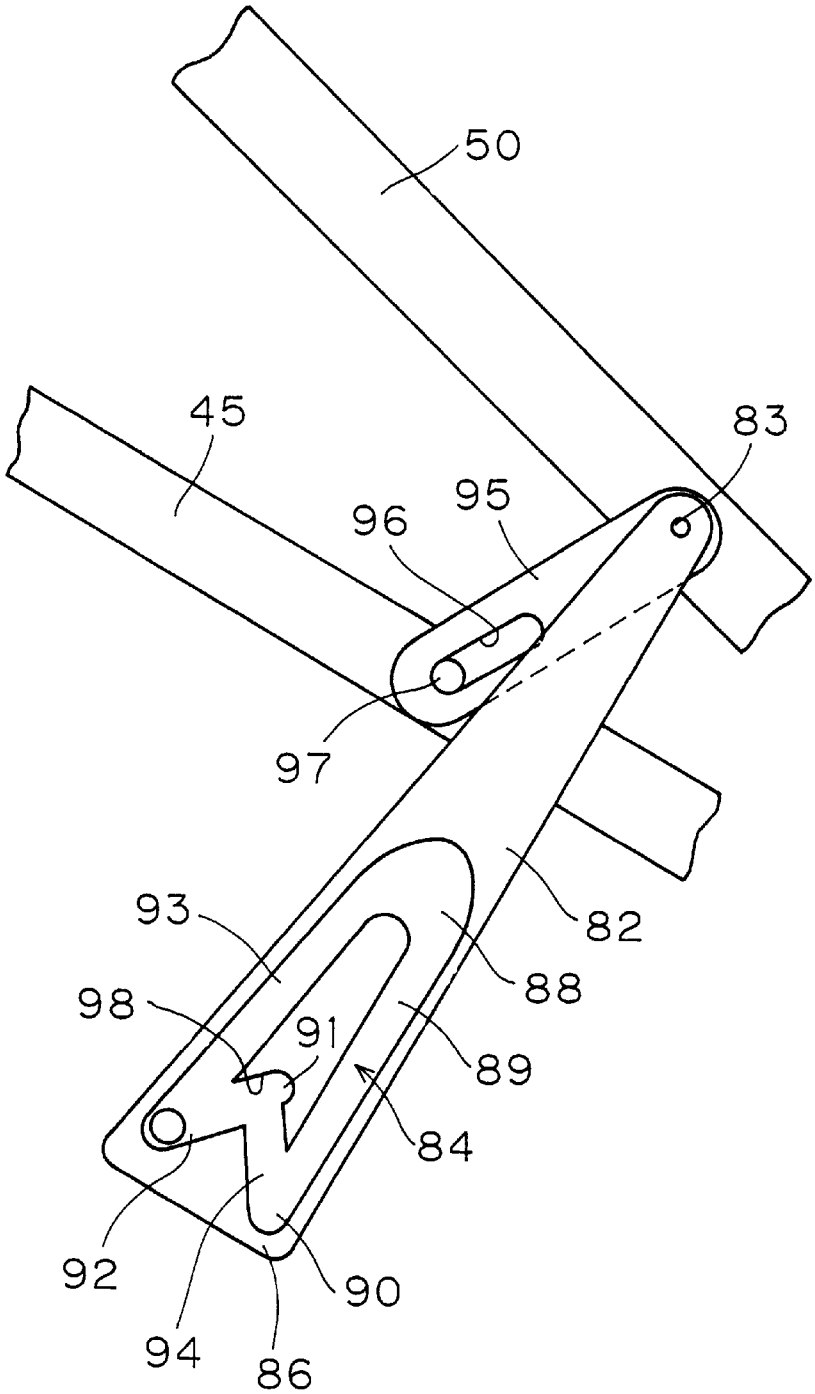
FIG. 17 is another diagram for explaining operation of the conveying guide.

Referring to FIG. 17, when the position regulating portion 92 of the guide Slot 84 reaches the position wherein it engages the engage pin 85, movement of the upper conveying guide 50 in the opening direction is regulated to prevent a further lift. In this state, if the upper conveying guide 50 is brought down, the first linkage 82 moves while the second guide portion 93 of the guide slot 84 is engaged in the engage pin 85.

When the lower conveying guide 45 reaches the closed position, the positioning member 107 of the guide 45 reaches a predetermined position and the engage pin 97 departs from the edge of the second linkage 95, to start narrowing the space between the upper and lower conveying guides 50, 45.

When the upper conveying guide 50 reaches the closed position, the first holding portion 88 of the guide slot 84 reaches position wherein it engages the engage pin 85. At the same time, the engage member 101 of the upper conveying guide 50 rotates against the action of the spring 103, to engage the engage pin 106. This functions at the same time to position the lower conveying guide 45 with respect to the main frame 30, and the lower conveying guide 45 with respect to the upper conveying guide 50.

Due to the weight of the upper and lower conveying guides 50, 45 and the first linkage 82, the lower end 86 of the first linkage 82 presses the spring member 87 against its extensive elasticity.

According to the above-described embodiment, when a sheet jam occurs in the sheet conveyance path through which sheets are conveyed to the intermediate tray 31, the upper and lower conveying guides 50, 45 can be easily brought into their parted open state by single-handedly lifting the grip 58 of the upper conveying guide 50. Further, it is possible to lock the upper conveying guide 50 in the open state by lifting the grip 58 uppermost and then reducing the force on the grip 58. This simplifies the operation and facilitates the sheet jam clearing process. In addition, the lower conveying guide 45 is maintained in the open state at the same time that the upper conveying guide 50 is locked in the open state. Therefore, a sheet jam between the lower conveying guide 50 and intermediate tray 31 can also be cleared, as well as a sheet jam in the sheet conveyance path between the upper and lower conveying guides 50, 45.

Additionally, in a state where the upper conveying guide 50 is located in the open state, the lock can be released easily by single-handedly lifting the grip 58, followed by lowering. This permits a quick return to operation after the sheet jam clearing process. The operations of opening and closing the upper conveying guide 50 can be accomplished single-handedly, in a rapid and easy operation.

The first linkage 82 and second linkage 95 may be supported on the upper conveying guide 50 by different support shafts.

As conveyors, opposing conveyor belts may be used instead of conveyor rollers.

Although the foregoing embodiments are adapted to a copying machine as an example of an image reproducing apparatus the present invention is also applicable to any image forming apparatus in which sheets are conveyed, e.g., printers or facsimiles.

Although the foregoing embodiments are adapted into a dual-sided copying section as an example of a sheet conveying unit, the present invention is also applicable to any sheet conveying unit having a structure for holding and conveying sheets and a sheet storing section disposed thereunder.

As stated above, in a sheet conveying unit according to the present invention, when a sheet jam occurs between upper and lower conveying sections, both sections are locked in predetermined spaced intervals by means of a linkage. Therefore, the upper conveying section is locked against return movement when an operator's hands are moved away from the upper conveying section. Thus sheet jams can be cleared easily through a single-handed operation. In addition, since the two conveying sections are linked by the first linkage, when the upper conveying section is lifted in the turning movement, the lower conveying section is turned with the 1 turning of the upper conveying section, thereby the upper part of the sheet storing section is opened. Consequently, in the event of a sheet jam in the sheet storing section, the jammed sheet can be easily removed only by turning the upper conveying section.

Various details of the present invention may be changed without departing from its spirit nor its scope. Furthermore, the foregoing description of the embodiments according to the present invention are provided for illustration only, and not for the purpose of limiting the invention as defined by the appended claims and their equivalents.

What is claimed is:

1. In an image reproducing apparatus sheet conveyance system, a sheet conveying unit comprising:

a unit main frame installed in the image forming apparatus by means enabling said unit main frame to be withdrawable transverse to a direction of sheet conveyance through the image forming apparatus;

a sheet storing section provided in said unit main frame;

a lower conveying section disposed above the sheet storing section, said lower conveying section including a lower conveying guide, one end of said lower conveying guide being pivotably supported on said unit main frame, and said lower conveying section including a lower conveying element circulatingly supported on said lower conveying guide;

an upper conveying section disposed above the lower conveying section, said upper conveying section including an upper conveying guide, one end of said upper conveying guide being pivotably supported on said unit main frame, and said upper conveying section including an upper conveying element circulatingly supported on said upper conveying guide, the upper and lower conveying elements operating in tandem for conveying sheets to said sheet storing section; and a first linkage, one end of said first linkage being pivotably supported on one of the upper and lower conveying guides, and an opposite end of said first linkage being engaged with the other of said upper and lower conveying guides; wherein said first linkage is configured such that the two conveying guides turn linked and spaced at predetermined intervals and lock at the predetermined intervals.

2. A sheet-conveying unit as set forth in claim 1, wherein:

said other of said upper and lower conveying guides includes an engaging element; and said first linkage includes a plate-shaped link main body, a fitting disposed on one end of said link main body and pivotably fit on said one of said upper and lower conveying guides, and an L-shaped slot for engagement with said engaging element of said other of said upper and lower conveying guides, said L-shaped slot having a first slot portion extending radially from a position apart from the fitting and with respect to a pivot point thereof, and a second slot portion extending circumferentially from the first slot portion with respect to the radial extension thereof, said second slot portion being configured such that said link main body turning on said engaging element drops under its own weight.

3. A sheet-conveying unit as set forth in claim 1, wherein the upper and lower conveying elements comprise mutually opposed upper and lower conveying rollers rotatably fit in the corresponding upper and lower conveying guides.

4. A sheet-conveying unit as set forth in claim 3, wherein one of the upper and lower conveying sections further includes a pressing member for pressing the corresponding conveying rollers of one of said upper and lower conveying guides against the corresponding conveying rollers of the other of said upper and lower conveying guides.

5. A sheet-conveying unit as set forth in claim 1, wherein said sheet storing section is an intermediate tray for turning over once-processed sheets in a dual-sided image reproduction process.

6. A sheet-conveying unit as set forth in claim 1, further comprising a second linkage, one end of said second linkage being pivotably fit onto one of said lower conveying guide and said unit main frame, and the other end of said second linkage being engaged with the other of said lower conveying guide and said unit main frame such that said lower conveying guide locks at a predetermined interval with respect to said sheet storing section.

7. In an image reproducing apparatus sheet conveyance system, a sheet conveying unit comprising:

a unit main frame installed in the image forming apparatus by means enabling said unit main frame to be withdrawable transverse to a direction of sheet conveyance through the image forming apparatus;

a sheet storing section provided in said unit main frame;

a lower conveying section disposed above the sheet storing section, said lower conveying section including a lower conveying guide, one end of said lower conveying guide being pivotably supported on said unit main frame, and said lower conveying section including a lower conveying element circulatingly supported on said lower conveying guide;

an upper conveying section disposed above the lower conveying section, said upper conveying section including an upper conveying guide, one end of said upper conveying guide being pivotably supported on said unit main frame, and said upper conveying section including an upper conveying element circulatingly supported on said upper conveying guide, the upper and lower conveying elements operating in tandem for conveying sheets to said sheet storing sections; and a lock mechanism including a first linkage for enabling said upper conveying element to be locked in a predetermined open position wherein said upper conveying element is opened out above said sheet storing section; and a support mechanism including a second linkage for supporting said lower conveying element such that wherein said upper conveying element is locked in said open position by said lock mechanism, said lower conveying element is opened out above said sheet storing section, parted by predetermined clearances respectively from said upper conveying element and said sheet storing section.

8. A sheet-conveying unit as set forth in claim 7, wherein:

said lock mechanism comprises an engage pin provided on the main frame; and said first linkage is formed with a guide slot having a first retaining position for slidably engaging said engage pin and positioning said engage pin when said upper conveying element is in a shut position, a second retaining position for retaining said engage pin when said upper conveying element is in said open position, a first guide member for guiding said engage pin from said first retaining position to said second retaining position, and a second guide member for guiding said engage pin from the second holding position to the first holding position.

9. A sheet-conveying unit as set forth in claim 8, wherein said lock mechanism further includes an urging means for urging said first linkage such that wherein said upper conveying element shifts from said closed position to said open position, said engage pin is brought from said first retaining position in which said engage pin is retained into engagement with said first guide slot.

10. A sheet-conveying unit as set forth in claim 9, wherein said first linkage is configured such that when said upper conveying element is in said open position, said first linkage turns under its own weight by turning said upper conveying element further upward, said engage pin is brought from said second retaining position into engagement with said second guide slot.

11. A sheet-conveying unit as set forth in claim 7, wherein:

said support mechanism includes an engage pin provided in said lower conveying element; and said second linkage is provided with a slot, one end of said slot being pivotably supported on said upper conveying element and the other end of said slot being engaged on said engage pin.

* * * * *